US006749371B2

(12) United States Patent
Jones

(10) Patent No.: US 6,749,371 B2
(45) Date of Patent: Jun. 15, 2004

(54) PILE GUIDE

(75) Inventor: Clive Jones, Dorchester (GB)

(73) Assignee: Fast Frames (UK) Limited, Dorchester (GB)

( * ) Notice: Subject to any disclaimer, the term of this patent is extended or adjusted under 35 U.S.C. 154(b) by 0 days.

(21) Appl. No.: 10/271,915

(22) Filed: Oct. 15, 2002

(65) Prior Publication Data

US 2003/0077127 A1 Apr. 24, 2003

(30) Foreign Application Priority Data

Oct. 18, 2001 (GB) ..... 0125063

(51) Int. Cl.[7] ..... E02D 7/00; E02D 13/04

(52) U.S. Cl. ..... 405/232; 405/231; 405/228

(58) Field of Search ..... 405/195.1, 224, 405/228, 231, 232, 244

(56) References Cited

U.S. PATENT DOCUMENTS

| | | | | | |
|---|---|---|---|---|---|
| 2,651,181 | A | * | 9/1953 | Alcorn et al. | 405/227 |
| 4,102,147 | A | | 7/1978 | Jansz | 405/228 |
| 4,154,552 | A | * | 5/1979 | VAN Bilderbeek | 405/229 |
| 4,589,802 | A | * | 5/1986 | Hampton | 405/227 |
| 4,679,964 | A | * | 7/1987 | Blandford | 405/224 |
| 4,687,380 | A | * | 8/1987 | Meek et al. | 405/224 |
| 4,697,959 | A | | 10/1987 | Kinnan | 405/232 |
| 4,740,108 | A | * | 4/1988 | Levee et al. | 405/221 |
| 4,932,811 | A | * | 6/1990 | Folding | 405/195.1 |
| 5,308,194 | A | * | 5/1994 | Carruba | 405/195.1 |
| 5,733,068 | A | * | 3/1998 | Reinert, Sr. | 405/232 |
| 6,325,158 | B1 | * | 12/2001 | Rangnes et al. | 175/5 |
| 6,354,767 | B1 | | 3/2002 | Jones | 405/232 |

FOREIGN PATENT DOCUMENTS

| | | | | |
|---|---|---|---|---|
| GB | 2111108 | * | 6/1983 | 405/227 |
| JP | 59-126822 | | 7/1984 | |
| JP | 06026290 | * | 2/1994 | 405/232 |
| JP | 09-203042 | | 8/1997 | |

* cited by examiner

*Primary Examiner*—Jong-Suk (James) Lee
(74) *Attorney, Agent, or Firm*—Sheridan Ross PC

(57) ABSTRACT

A pile guide, for supporting a pile as it is driven into a substrate, has a base frame and a pile guide member mounted on the base frame. The base frame comprises one or more substrate-engaging supports, moveable between an inoperative position and an operative position, with movement of the or each substrate-engaging support into the operative position resulting in an increase in the area of the base frame which, in use, rests on the substrate.

23 Claims, 6 Drawing Sheets

PILE GUIDE

FIELD OF THE INVENTION

The present invention relates to a pile guide, particularly, but not exclusively, to a pile guide for underwater pile driving, e.g. for stabbing poles directly into the seabed.

BACKGROUND OF THE INVENTION

It is known to provide a guide for aligning a pile with the surface of a substrate into which the pile is to be driven and to provide stability for a piling hammer. One such guide is described in the present applicant's International application published under WO99/11872 (U.S. Pat. No. 6,354,767 B1). As shown in FIG. 1, the guide is supported on a base frame (10), which has a substantially rectangular footprint. The base frame is made up of a welded framework of girders (12) to which mud mats (14) are attached to spread the load (weighing about 35 tonnes) across the surface of the substrate (e.g. sea bed). Even so, when deployed on soft soils e.g. silt, there is a risk that the guide may sink into the substrate, either under its own weight or during pile driving. One way of alleviating even obviating this risk is to increase the basal area of the base frame to spread the load still further.

Difficulties have been encountered in controlling the deployment of large objects such as pile guides at sea due to hydrodynamic forces generated by wave-induced movement at the water surface. In many cases, the more water which can become "trapped" above the object during deployment, the greater the hydrodynamic forces might be. For this reason, objects with large flat surfaces (e.g. the base frame of a pile guide) are often deployed at an angle to encourage water to run off them rather than become trapped, thereby minimising potential hydrodynamic forces at work. Even so, certain large objects may only be deployed in relatively calm seas to ensure that hydrodynamic forces acting on the objects do not exceed safe, threshold levels.

The present applicant has appreciated the desirability of a novel pile guide which is more stable in soft soils than conventional pile guides, and yet which is at least as readily deployed at sea as existing pile guides.

SUMMARY OF THE INVENTION

In accordance with one aspect of the present invention, there is provided a pile guide for supporting a pile as it is driven into a substrate, comprising a base frame and a pile guide member mounted on the base frame, wherein the base frame comprises at least one substrate-engaging support, moveable between an inoperative position and an operative position, with movement of the at least one substrate-engaging support into the operative position resulting in an increase in area of an active surface of the base frame which, in use, rests on the substrate.

The at least one substrate-engaging support may be mounted on the pile guide for movement relative thereto and, also, may be attached to the base frame via a respective pivot.

The present applicant has found that the potential difficulties of deploying pile guides at sea, and the potential problems of supporting pile guides on soft soils may both be alleviated by using the moveable substrate-engaging support. When in the inoperative position, the substrate-engaging support may not contribute significantly to the "footprint" or substrate-engaging area of the base frame, which is clearly advantageous as it should not unduly increase hydrodynamic forces acting on the pile guide during deployment at sea. When in the operative position, the substrate-engaging support may contribute significantly to the "footprint" of the base frame, helping to resist any tendency to sink in soft soils.

The base frame may further comprise a hub portion to which the at least one substrate-engaging support is mounted. The at least one substrate-engaging support may be pivotally connected to the hub portion for pivotal movement around a respective pivot axis. The at least one pivot axis may be aligned substantially parallel to the base plane of the base frame.

A locking mechanism may be provided to lock the at least one substrate-engaging support when moved into the operative position. The locking mechanism may comprise a bolting arrangement comprising a bolt and at least one aperture engagable by the bolt. For example, a bolt may engage a pair of apertures, one associated with a respective substrate-engaging support, the other associated with the hub portion, the apertures being in registration when the respective substrate-engaging support is in the operative position. The bolting arrangement may be activated by a diver or by remote control.

The at least one substrate-engaging support may be biased by a biasing arrangement (e.g. a counterweighting arrangement) to move into the operative position when released from the inoperative position. In this way it is possible for the pile guide to be launched in a retracted form and subsequently to be reconfigured in an extended form. For example, during deployment, the at least one substrate-engaging support may be restrained by a restraining device attached to the pile guide, e.g. tethered to the pile guide member, to restrain it in the inoperative position. As soon as the tether is released (e.g. cut), the substrate-engaging support is urged (e.g. under gravity) to the operative position.

Alternatively, or in addition, an actuator may be provided to drive the at least one substrate-engaging support from the inoperative position to the operative position. The actuator may comprise a hydraulic ram, and may also hold the at least one substrate-engaging support in the operative position, thereby preventing movement back towards the inoperative position.

The pile guide may comprise a plurality (e.g. four) substrate-engaging supports symmetrically disposed around the hub portion.

The substrate-engaging supports may increase the substrate-engaging area of the base frame by at least 10%, perhaps at least 25%, when moved from the inoperative position to the operative position. Furthermore, the substrate-engaging supports may increase the substrate-engaging area of the base frame by at least 50%, perhaps even at least 100%, when moved from the inoperative positions to the operative position.

In accordance with another aspect of the present invention, there is provided a method of deploying a pile guide at sea, comprising the steps of:

providing a pile guide comprising a base frame and a pile guide member mounted on the base frame, the base frame comprising at least one substrate-engaging support moveable between an inoperative position and an operative position;

lowering the pile guide into the sea through its splash zone with the at least one substrate-engaging support in the inoperative position so that the substrate-engaging area of the base frame is at a minimum; and moving the at least one substrate-engaging support into the operative position to increase the substrate-engaging area of the base frame when the pile guide has been lowered through the sea splash zone.

The method may further comprise: lowering the pile guide until it is adjacent, i.e. a relatively short distance from (e.g. within 10 m) and directly above the substrate on which it will rest before moving the at least one substrate-engaging support into the operative position.

Furthermore, while lowering the pile guide through the sea splash zone, the pile guide may be orientated with its largest planar surface inclined to the sea level.

BRIEF DESCRIPTION OF THE DRAWINGS

An embodiment of the invention will now be described by way of example with reference to the accompanying drawings, in which.

DESCRIPTION OF THE SPECIFIC EMBODIMENT

Figure 1:
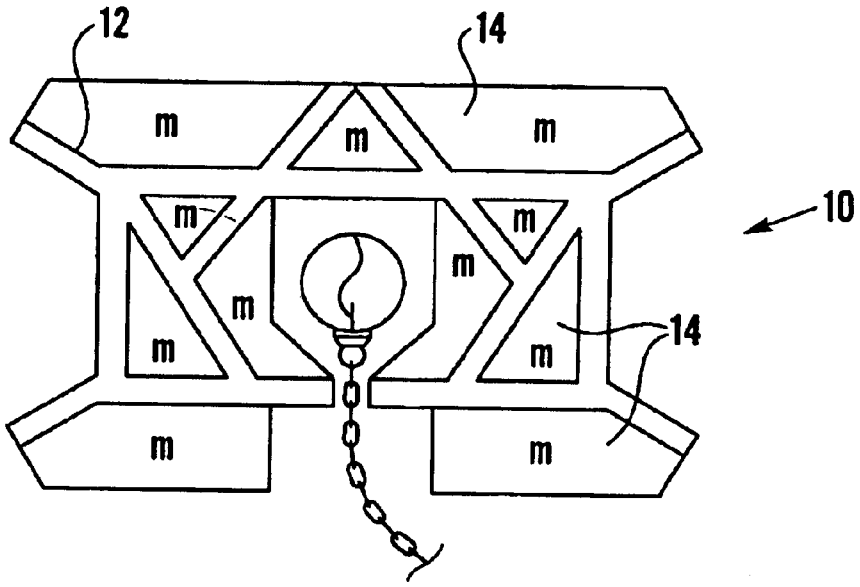
Fig. 1 (Prior Art)
FIG. 1 is a plan view of a prior art base frame.
Figure 6:
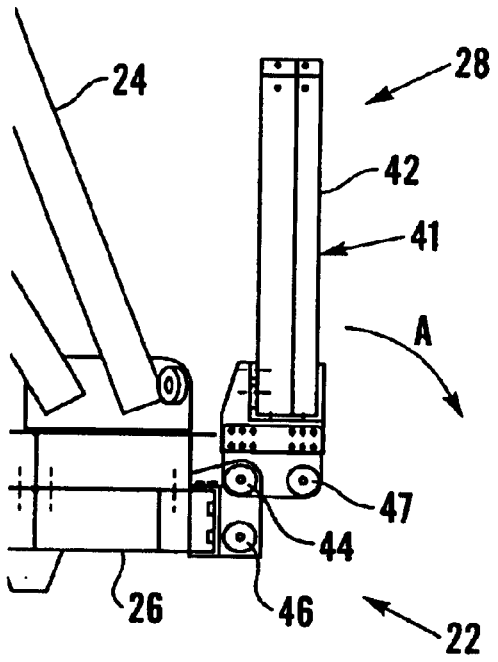
FIG. 6 is a view showing detail of the pivotable support of the apparatus of FIG. 4 or 5, the support in its inoperative position.
Figure 2:
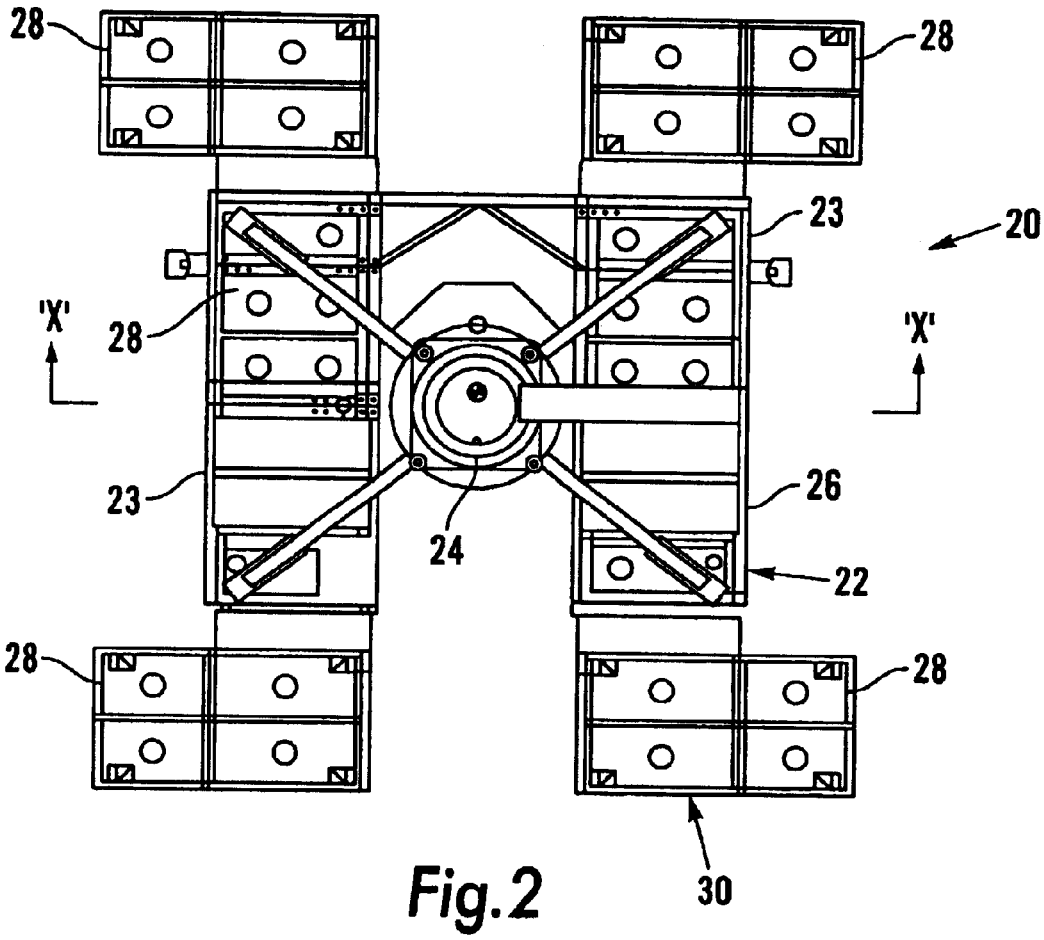
FIG. 2 is a plan view of a pile guide embodying one aspect of the present invention, with pivotal supports in their operative position.
Figure 3:
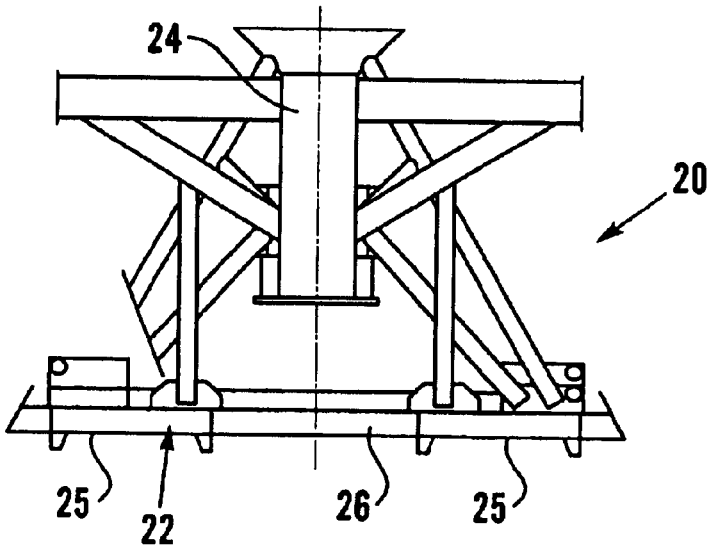
FIG. 3 is a section through plane X—X in FIG. 2.

FIG. 2 shows a plan view of a pile guide (20) as it would be deployed on a substrate such as a soft soil seabed. The pile guide (20) comprises a base frame (22) and a pile guide member (24) mounted on the base frame (22). In fact, base frame (22) comprises a rigid member or hub portion (26) and four substrate-engaging supports (28) which are pivotally coupled to the hub portion (26). The hub portion (26) and substrate-engaging supports are each substantially flat and are disposed in a common plane. In this embodiment, the hub portion (26) includes a pair of spaced-apart, planar members (23), forming mudmats, symmetrically on opposite sides of the pile guide member (24). The members (23) define the basal surface (25) of the hub portion (26). Thus, the hub portion (26) and substrate-engaging supports (28) each contribute to the substrate-engaging area or footprint (30) of the base frame which rests on the substrate. The substrate-engaging area or footprint of the base frame is also referred to herein as the active surface of the base frame. The active surface is increased by at least 100% when the supports (28) are in their lowered, operative position.

Figure 4:
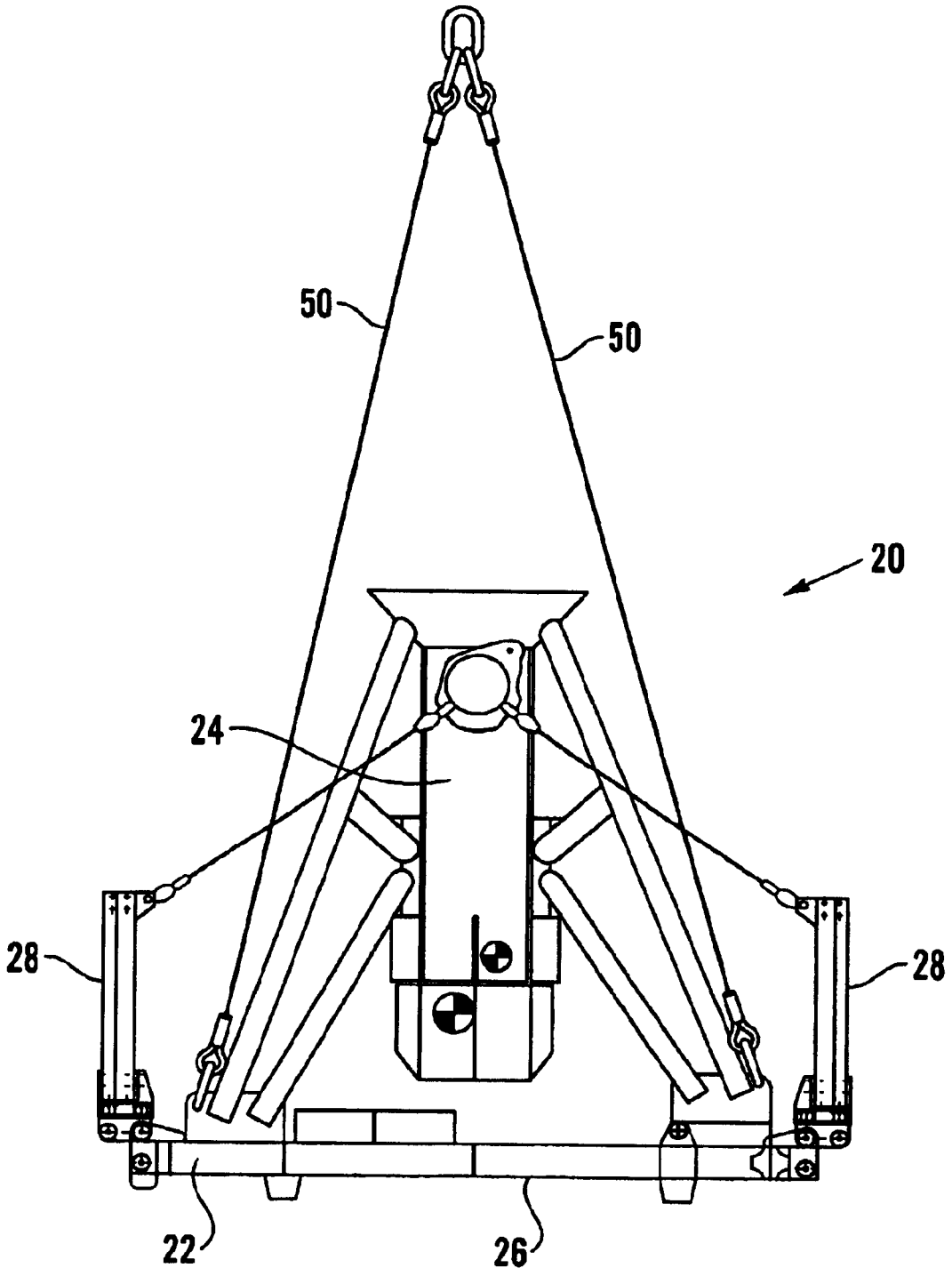
FIG. 4 is a sectional view, perpendicular to the view of FIG. 3, of the pile guide of FIG. 2, showing pivotal supports in their inoperative position and with lifting gear attached.

FIG. 4 shows the pile guide (20) before it is positioned on to the substrate. The substrate-engaging supports (28) are in a retracted or inoperative position, each occupying a plane substantially perpendicular to the basal surface (25) of the hub portion (26). In this configuration, the base frame (22) has a minimum "footprint" profile, which may be helpful when deploying the pile guide (20) in rough seas as hydrodynamic forces (e.g. drag) acting upon the pile guide (20) will be lower, especially while the pile guide (20) is lowered via cables (50) through the splash zone (i.e. the still region beneath wave-inducted turbulence).

Figure 5:
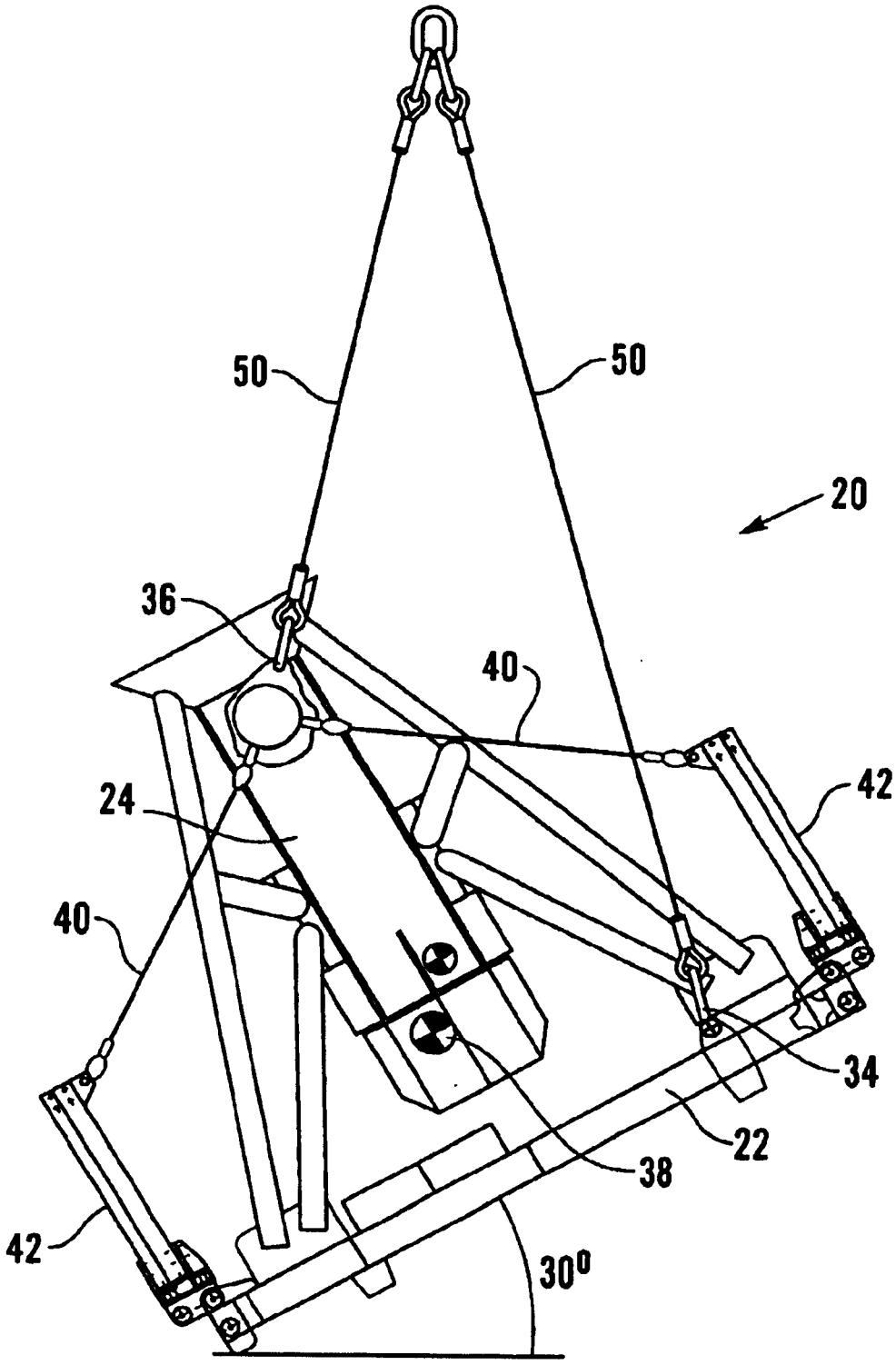
FIG. 5 is a sectional view, again perpendicular to the view in FIG. 3, of a tilted lifting position according to the invention and with lifting gear in an alternative position to that shown in FIG. 4.

In fact, FIG. 5 shows the pile guide (20) with the basal surface (25) of the hub portion (26) inclined to the horizontal, which is a useful way of further reducing the effect of hydrodynamic forces acting on the pile guide (20) during deployment. The inclined disposition is achieved by offsetting the lifting points (34,36) to one side of the centre of gravity (38).

As shown in FIGS. 4 & 5, the substrate-engaging supports (28) are restrained by tethers (40) to the pile guide member (24) and thus retained in the inoperative position. Once the pile guide (20) is lowered through the splash zone and righted into the FIG. 4 orientation, the substrate-engaging supports (28) may be released, for example by removing the tethers (40) with the aid of a diver or remote control. A biasing arrangement (41), provided by counterweights (42) on or in the moveable substrate-engaging supports (28), then causes each substrate-engaging support (28) to pivot around its respective pivot axis (44) in the direction of arrow A into the operative position under gravity.

Figure 7:
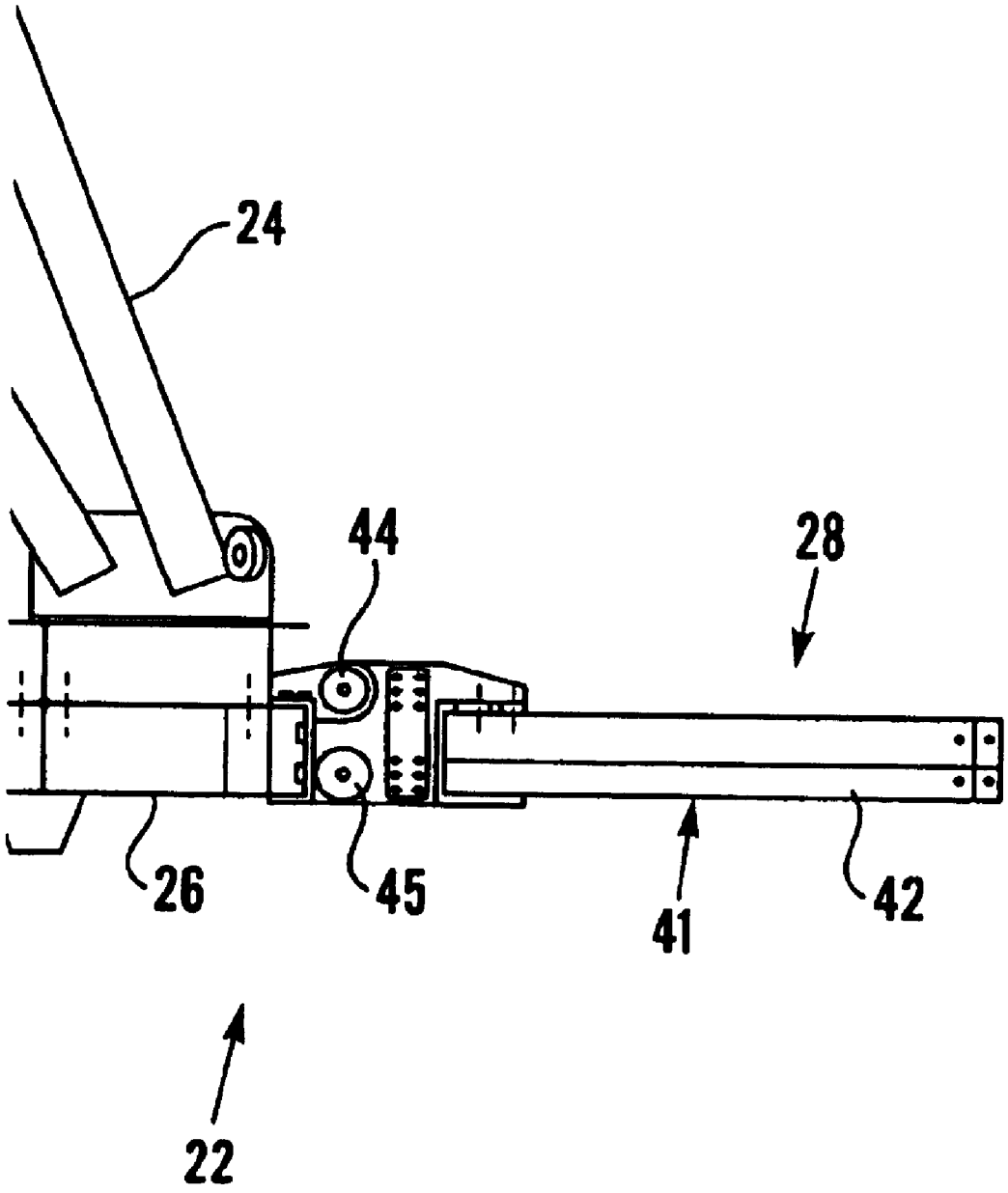
FIG. 7 is a view taken similarly to FIG. 6 but with the support in its operative position.

In pivoting to the operative position, shown in FIGS. 2 and 7, apertures (46,47) are brought into registration, ready to receive a bolt (45) to lock the substrate-engaging support (28) into the operative position, which in this embodiment is horizontal or approximately horizontal.

The invention has now been described in detail for purposes of clarity of understanding. However, it will be appreciated that certain changes and modifications may be practised within the scope of the appended claims. For instance, different designs of the base frame, e.g. different footprints, may be employed within the spirit of the invention. It should also be noted that the pile guide member (22) illustrated is just one of several different designs which could be used in combination with the base frame (22).

Figure 8:
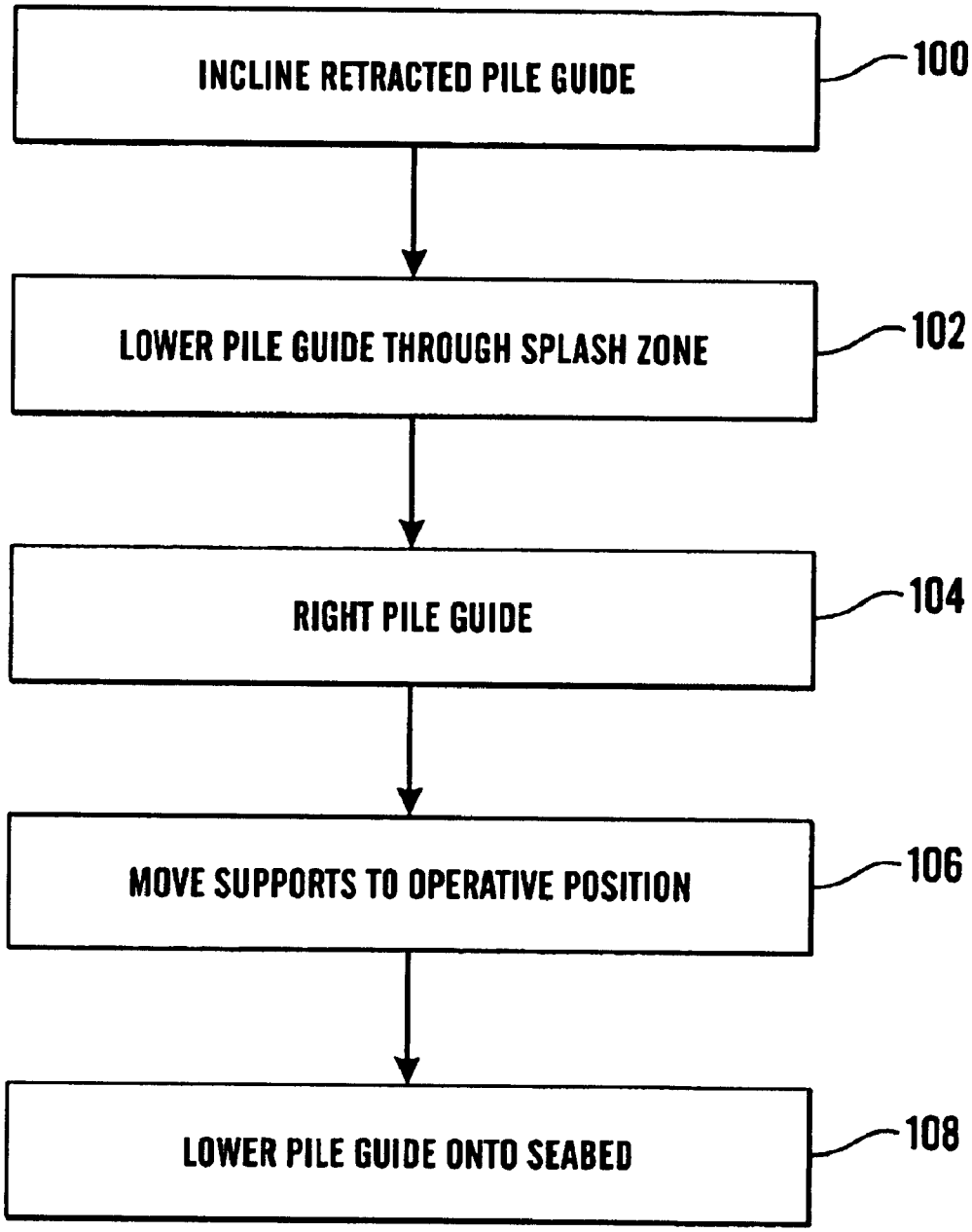
FIG. 8 is a flow chart illustrating a method according to a second aspect of the invention.

The method of deployment in the sea is explained with reference to FIG. 8. A retracted pile guide (20) is provided at step (100) and orientated so that the basal surface of the hub portion (26) is inclined to the sea level (as shown in FIG. 5). The pile guide (20) is lowered in step (102) through the splash zone, after which the pile guide (20) is righted in step (104) to achieve the configuration shown in FIG. 4. Next at step (106) the substrate-engaging supports (28) are moved into their operative position so that the pile guide (20) is extended into the configuration shown in FIG. 2. Finally in step (106) the pile guide (20) is lowered until the active surface of the base frame (22) is resting on the seabed.

What is claimed is:

1. A pile guide for supporting a pile as it is driven into a substrate, comprising a base frame and a pile guide member mounted on the base frame, wherein the base frame comprises at least one substrate-engaging support, moveable between an inoperative position and an operative position, with movement of the at least one substrate-engaging support into the operative position resulting in an increase in area of at least 25% of an active surface of the base frame which, in use, rests on the substrate.

2. A pile guide according to claim 1, wherein the base frame further comprises a hub portion to which the at least one substrate-engaging support is mounted.

3. A pile guide according to claim 2, wherein the at least one substrate-engaging support is pivotally connected to the hub portion for pivotal movement around a respective pivot axis.

4. A pile guide according to claim 3, wherein the respective pivot axis is aligned substantially parallel to the active surface of the base frame.

5. A pile guide according to claim 2, comprising a plurality of substrate-engaging supports symmetrically disposed around the hub portion.

6. A pile guide according to claim 1, wherein a locking mechanism is provided to lock the at least one substrate-engaging support when moved into the operative position.

7. A pile guide according to claim 6, wherein the locking mechanism comprises a bolting arrangement comprising a bolt and at least one aperture engagable by the bolt.

8. A pile guide according to claim 7, wherein the bolt 12 engages a pair of apertures, one associated with a respective substrate-engaging support, the other associated with the hub portion, the apertures being in registration when the respective substrate-engaging support is in the operative position.

9. A pile guide according to claim 7, wherein the bolt arrangement is configured to be activated by one of a diver and remote control.

10. A pile guide according to claim 1, wherein the at least one substrate-engaging support is biased by a biasing arrangement to move into the operative position when released from the inoperative position.

11. A pile guide according to claim 10, wherein the biasing arrangement comprises a counterweighting arrangement.

12. A pile guide according to claim 11, wherein the counterweighting arrangement comprises a counterweight on the respective at least one substrate-engaging support.

13. A pile guide according to claim 10, including at least one restraining device attached to the pile guide to restrain the at least one substrate-engaging support in the inoperative position.

14. A pile guide according to claim 13, wherein the at least one restraining device comprises a tether.

15. A pile guide according to claim 13, comprising an actuator to drive the at least one substrate-engaging support from the inoperative position to the operative position.

16. A pile guide according to claim 15, wherein the actuator also holds the at least one substrate-engaging support in the operative position, thereby preventing movement back towards the inoperative position.

17. A pile guide according to claim 1, comprising an actuator to drive the at least one substrate-engaging support from the inoperative position to the operative position.

18. A pile guide according to claim 17, wherein the actuator also holds the at least one substrate-engaging support in the operative position, thereby preventing movement back towards the inoperative position.

19. A pile guide according to claim 1, wherein the at least one substrate-engaging support increases the substrate-engaging area of the base frame by at least 50%, when moved from the inoperative position to the operative position.

20. A pile guide according to claim 1, having one or more lifting points offset to one side of the center of gravity of the pile guide.

21. A method of deploying a pile guide at sea, comprising the steps of:

providing a pile guide comprising a base frame and a pile guide member mounted on the base frame, the base frame r comprising at least one substrate-engaging support moveable between an inoperative position and an operative position;

lowering the pile guide into the sea through its splash zone with the at least one substrate-engaging support in the inoperative position so that the substrate-engaging area of the base frame is at a minimum; and moving the at least one substrate-engaging support to the operative position to increase the substrate engaging area of the base frame by at least 25% when the pile guide has been lowered through the sea splash zone.

22. A method according to claim 21, wherein, while the pile guide is lowered through the sea splash zone, the pile guide is orientated with its largest planar surface inclined to the sea level.

23. A method according to claim 21, further comprising lowering the pile guide until it is adjacent and directly above the substrate on which it will rest before moving the at least one substrate-engaging support into the operative position.

* * * * *